US008340330B2

(12) United States Patent
Yoon et al.

(10) Patent No.: US 8,340,330 B2
(45) Date of Patent: Dec. 25, 2012

(54) AUDIO APPARATUS FOR WIRELESSLY TRANSMITTING AUDIO SIGNAL, AUDIO SYSTEM, AND AUDIO SIGNAL TRANSMISSION METHOD THEREOF

(75) Inventors: Eung-sik Yoon, Suwon-si (KR); Dae-hyun Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 991 days.

(21) Appl. No.: 12/199,980

(22) Filed: Aug. 28, 2008

(65) Prior Publication Data

US 2009/0245548 A1 Oct. 1, 2009

(30) Foreign Application Priority Data

Mar. 25, 2008 (KR) ..... 10-2008-0027329

(51) Int. Cl.
*H04R 5/02* (2006.01)
*H04R 5/00* (2006.01)

(52) U.S. Cl. ..... 381/307; 381/300; 381/80; 381/105; 381/79; 381/311

(58) Field of Classification Search ..... 381/307, 381/300, 2, 80, 105, 6, 16, 14, 77, 79, 311
See application file for complete search history.

(56) References Cited

U.S. PATENT DOCUMENTS

| | | | | |
|---|---|---|---|---|
| 5,666,422 | A * | 9/1997 | Harrison et al. | 381/18 |
| 5,946,343 | A * | 8/1999 | Schotz et al. | 375/141 |
| 6,466,832 | B1 * | 10/2002 | Zuqert et al. | 700/94 |
| 6,487,296 | B1 * | 11/2002 | Allen et al. | 381/80 |
| 6,590,982 | B1 * | 7/2003 | Chen | 381/2 |
| 6,608,907 | B1 * | 8/2003 | Lee | 381/311 |
| 6,684,060 | B1 * | 1/2004 | Curtin | 375/146 |
| 6,741,708 | B1 * | 5/2004 | Nakatsugawa | 381/79 |
| 6,959,991 | B2 * | 11/2005 | Ho et al. | 353/119 |
| 7,024,003 | B2 * | 4/2006 | Dupeire | 381/79 |
| 7,539,889 | B2 * | 5/2009 | Celinski et al. | 713/400 |
| 8,050,203 | B2 * | 11/2011 | Jacobsen et al. | 370/310 |
| 2002/0072816 | A1 * | 6/2002 | Shdema et al. | 700/94 |
| 2003/0235314 | A1 * | 12/2003 | Wang | 381/79 |
| 2004/0037433 | A1 * | 2/2004 | Chen | 381/79 |
| 2004/0039462 | A1 * | 2/2004 | Chen | 700/94 |
| 2004/0264708 | A1 * | 12/2004 | Dupeire | 381/79 |
| 2006/0009985 | A1 * | 1/2006 | Ko et al. | 704/500 |
| 2006/0132715 | A1 * | 6/2006 | Ho et al. | 353/15 |
| 2008/0008338 | A1 * | 1/2008 | Yoon et al. | 381/303 |
| 2011/0149768 | A1 * | 6/2011 | Kang et al. | 370/252 |
| 2011/0150228 | A1 * | 6/2011 | Yoon et al. | 381/17 |

FOREIGN PATENT DOCUMENTS

| | | |
|---|---|---|
| KR | 2002-57387 | 7/2002 |
| KR | 2004-76983 | 9/2004 |

* cited by examiner

*Primary Examiner* — Edgardo San Martin
(74) *Attorney, Agent, or Firm* — Stanzione & Kim, LLP

(57) ABSTRACT

An audio apparatus includes a main unit to extract audio signals for at least two channels from a multichannel audio signal; and a transmitter to wirelessly transmit at least one audio signal of the extracted audio signals to a first receiver, and to wirelessly transmit at least one other audio signal of the extracted audio signals to a second receiver.

21 Claims, 6 Drawing Sheets

AUDIO APPARATUS FOR WIRELESSLY TRANSMITTING AUDIO SIGNAL, AUDIO SYSTEM, AND AUDIO SIGNAL TRANSMISSION METHOD THEREOF

CROSS-REFERENCE TO RELATED APPLICATIONS

This application claims the benefit of Korean Patent Application No. 2008-27329 filed on Mar. 25, 2008, in the Korean Intellectual Property Office, the disclosure of which is incorporated herein by reference in its entirety.

BACKGROUND OF THE INVENTION

1. Field of the Invention

Aspects of the invention relate to an audio apparatus, an audio system, and an audio signal transmission method, and more particularly to an audio apparatus for wirelessly transmitting an audio signal, an audio system, and an audio signal transmission method thereof.

2. Description of the Related Art

Due to the rapid development of multimedia technology, it is now possible for users to view high-quality video on large display devices and listen to high-quality audio at home using multimedia devices, such as high-definition televisions (HDTVs) and digital versatile disc (DVD) players.

A home theater system provides high-quality video and stereo audio, and uses a multichannel surround sound system, such as a 5.1 channel sound system. A home theater system using 5.1 channels extracts and reproduces sound for each channel, and thus provides clear and realistic sound of the highest quality.

The 5.1 channel sound system includes a main unit to support a multichannel surround sound system, such as a 5.1 channel Digital Theater System (DTS) system and/or a 5.1 channel Dolby Digital system, and 5.1 channel speakers including a front left speaker, a center speaker, a front right speaker, a rear left speaker, a rear right speaker, and a subwoofer speaker.

Each of the speakers is placed at an appropriate position to provide 5.1 channel audio having high-quality sound.

However, since each speaker is connected to the main unit by wire, if the speakers are far from the main unit, the speaker wires may cross the user's listening space. As a result, there are limitations on where speakers may be placed, and the presence of the speaker wires may detract from the appearance of the home theater system.

SUMMARY OF THE INVENTION

Aspects of the invention relate to an audio apparatus that wirelessly transmits an audio signal to a remote speaker, and a method of transmitting an audio signal thereof.

According to an aspect of the invention, an audio apparatus includes a main unit to extract audio signals for at least two channels from a multichannel audio signal; and a transmitter to wirelessly transmit at least one audio signal of the extracted audio signals to a first receiver, and to wirelessly transmit at least one other audio signal of the extracted audio signals to a second receiver.

According to an aspect of the invention, the at least one audio signal wirelessly transmitted to the first receiver is a subwoofer channel audio signal for a subwoofer channel, and the at least one other audio signal wirelessly transmitted to the second receiver is rear channel audio signals for rear channels; or the at least one audio signal wirelessly transmitted to the first receiver is the rear channel audio signals for the rear channels, and the at least one other audio signal wirelessly transmitted to the second receiver is the subwoofer channel audio signal for the subwoofer channel.

According to an aspect of the invention, the transmitter is detachably mounted on the main unit.

According to an aspect of the invention, the main unit detects whether the transmitter is mounted in the main unit, and if the transmitter is mounted on the main unit, the main unit controls the transmitter to wirelessly transmit the at least one audio signal and the at least one other audio signal to the first receiver and the second receiver, respectively.

According to an aspect of the invention, the first receiver and the second receiver are not connected by wire to the main unit, and are not connected by wire to each other.

According to an aspect of the invention, the at least one audio signal wirelessly transmitted to the first receiver is rear channel audio signals for the rear channels; and the first receiver includes a first reception module to receive the rear channel audio signals for the rear channels; and a first signal amplifier to amplify the received rear channel audio signals for the rear channels.

According to an aspect of the invention, the rear channel audio signals for the rear channels include a rear left audio signal for a rear left channel, and a rear right audio signal for a rear right channel; and the first signal amplifier outputs an amplified rear left audio signal for the rear left channel to a rear left speaker, and outputs an amplified rear right audio signal for the rear right channel to a rear right speaker.

According to an aspect of the invention, the at least one other audio signal wirelessly transmitted to the second receiver is a subwoofer channel audio signal for a subwoofer channel; and the second receiver includes a second reception module to receive the subwoofer channel audio signal for the subwoofer channel; a second signal amplifier to amplify the received subwoofer channel audio signal for the subwoofer channel; and a speaker to reproduce the amplified subwoofer channel audio signal for the subwoofer channel.

According to an aspect of the invention, a method of transmitting audio signals includes extracting audio signals for at least two channels from a multichannel audio signal; wirelessly transmitting at least one audio signal of the extracted audio signals to a first receiver; and wirelessly transmitting at least one other audio signal of the extracted audio signals to a second receiver.

According to an aspect of the invention, the at least one audio signal wirelessly transmitted to the first receiver is a subwoofer channel audio signal for a subwoofer channel, and the at least one other audio signal wirelessly transmitted to the second receiver is rear channel audio channels for rear channels; or the at least one audio signal wirelessly transmitted to the first receiver is the rear channel audio signals for the rear channels, and the at least one other audio signal wirelessly transmitted to the second receiver is the subwoofer channel audio signal for the subwoofer channel.

According to an aspect of the invention, the method further includes detecting whether a transmitter is available; wherein the wirelessly transmitting of the at least one audio signal to the first receiver includes controlling the transmitter to wirelessly transmit the at least one audio signal to the first receiver if the transmitter is available; and the wirelessly transmitting of the at least one other audio signal to the second receiver includes controlling the transmitter to wirelessly transmit the at least one other audio signal to the second receiver if the transmitter is available.

According to an aspect of the invention, the at least one audio signal and the at least one other audio signal are wirelessly transmitted from a main unit to the first receiver and the second receiver, respectively; and the first receiver and the second receiver are not connected by wire to the main unit, and are not connected by wire to each other.

According to an aspect of the invention, an audio system includes a main unit to extract audio signals for at least two channels from a multichannel audio signal; a transmitter to wirelessly transmit at least one audio signal of the extracted audio signals, and to wirelessly transmit at least one other audio signal of the extracted audio signals; a first receiver to wirelessly receive the at least one audio signal wirelessly transmitted by the transmitter; and a second receiver to wirelessly receive the at least one other audio signal wirelessly transmitted by the transmitter.

According to an aspect of the invention, the at least one audio signal wirelessly received by the first receiver is a subwoofer channel audio signal for a subwoofer channel, and the at least one other audio signal wirelessly received by the second receiver is rear channel audio signals for rear channels; or the at least one audio signal wirelessly received by the first receiver is the rear channel audio signals for the rear channel, and the at least one other audio signal wirelessly received by the second receiver is the subwoofer channel audio signal for the subwoofer channel.

According to an aspect of the invention, the extracted audio signals include a front left channel audio signal for a front left channel; and a front right channel audio signal for a front right channel; and the audio system further includes a third receiver connected to the main unit by wire to receive the front left channel audio signal for the front left channel by wire from the main unit; and a fourth receiver connected to the main unit by wire to receive the front right channel audio signal for the front right channel by wire from the main unit.

According to an aspect of the invention, an audio system includes a main unit to extract a plurality of audio signals from a multichannel audio signal, the plurality of audio signals including an audio signal for a front left channel; an audio signal for a center channel; an audio signal for a front right channel; an audio signal for a rear left channel; an audio signal for a rear right channel; and an audio signal for a subwoofer channel. The audio system further includes plurality of speakers including a front left speaker to reproduce the audio signal for the front left channel; a center speaker to reproduce the audio signal for the center channel; a front right speaker to reproduce the audio signal for the front right channel; a rear left speaker to reproduce the audio signal for the rear left channel; a rear right speaker to reproduce the audio signal for the rear right channel; and a subwoofer to reproduce the audio signal for the subwoofer channel. The audio system further includes a first receiver connected by wire to at least one of the plurality of speakers; a second receiver connected by wire to at least one of the plurality of speakers other than the at least one of the plurality of speakers connected by wire to the first receiver; and a transmitter to wirelessly transmit to the first receiver and the second receiver ones of the plurality of audio signals corresponding to the ones of the plurality of speakers connected by wire to the first receiver and the second receiver; wherein any of the plurality of speakers not connected by wire to the first receiver and the second receiver are connected by wire to the main unit.

Additional aspects and/or advantages of the invention will be set forth in part in the description that follows and, in part, will be obvious from the description, or may be learned by practice of the invention.

BRIEF DESCRIPTION OF THE DRAWINGS

A better understanding of the invention will become apparent from the following detailed description of example embodiments of the invention and the claims when read in connection with the accompanying drawings, all forming a part of the disclosure of the invention. While the following written and illustrated disclosure focuses on disclosing example embodiments of the invention, it should be clearly understood that the same is by way of illustration and example only, and that the invention is not limited thereto. The spirit and scope of the present invention are limited only by the terms of the claims and their equivalents. The following represents brief descriptions of the drawings, wherein:

DETAILED DESCRIPTION OF THE EMBODIMENTS

Figure 1:
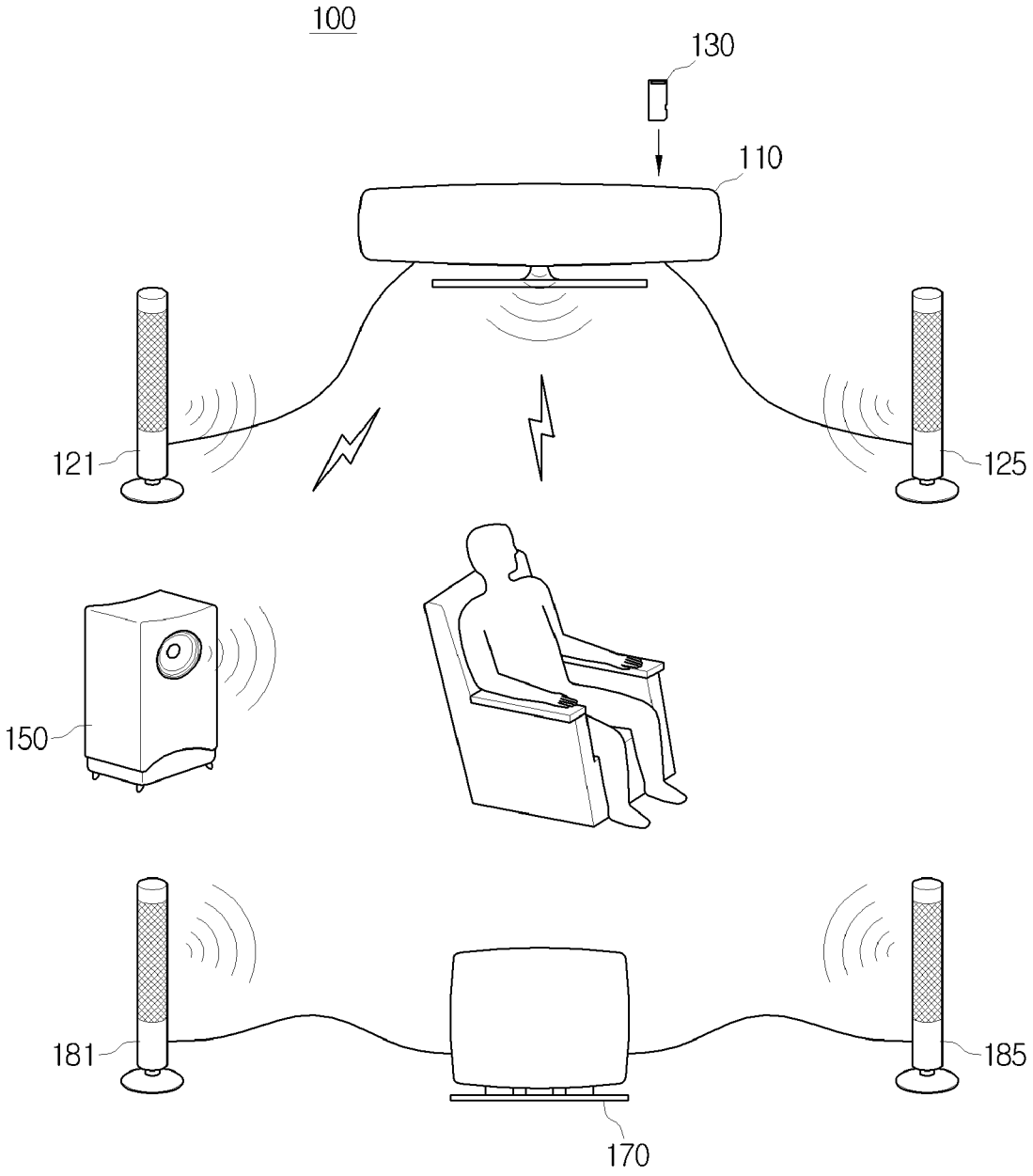
FIG. 1 is a diagram of an audio system that wirelessly transmits an audio signal according to an aspect of the invention.

Reference will now be made in detail to embodiments of the invention, examples of which are shown in the accompanying drawings, wherein like reference numerals refer to like elements throughout. The embodiments are described below in order to explain the invention by referring to the figures.

FIG. 1 is a diagram of an audio system that wirelessly transmits an audio signal according to an aspect of the invention, and provides a user with broadcast programs received from a broadcast station and/or multimedia stored in a storage medium.

Referring to FIG. 1, an audio system 100 includes a main unit 110, a front left speaker 121, a front right speaker 125, a transmitter 130, a subwoofer 150, a signal amplifier 170, a rear left speaker 181, a center speaker 183 (not shown in FIG. 1 but shown in FIG. 2) and a rear right speaker 185.

The overall operation of the audio system 100 will be explained below. The structure of the main unit 110, the subwoofer 150, and the signal amplifier 170 will be explained with reference to FIGS. 2 to 4, and the structure of the transmitter 130 and reception modules 151 and 171 (not shown in FIG. 1 but shown in FIGS. 3, 4, and 6) will be explained with reference to FIGS. 5 and 6.

The main unit 110 controls an overall operation of the audio system 100. The main unit 110 is connected by wires to the front left speaker 121 and the front right speaker 125, and transmits audio signals for a front left channel and a front right channel by wires to the front left speaker 121 and the front right speaker 125, respectively.

The front left speaker 121 outputs the audio signal for the front left channel, and the front right speaker 125 outputs the audio signal for the front right channel.

The main unit 110 is wirelessly connected to the subwoofer 150 and the signal amplifier 170, and the signal amplifier 170 is connected by wires to the rear left speaker 181 and the rear right speaker 185.

The signal amplifier 170 wirelessly receives audio signals for a rear left channel and a rear right channel, amplifies the received audio signals, and transmits the amplified signals by wires to the rear left speaker 181 and the rear right speaker 185, respectively.

The transmitter 130 may be implemented as a card, and is detachably mounted on the main unit 110. The transmitter 130 wirelessly transmits audio signals from the main unit 110 to the subwoofer 150 and the signal amplifier 170 as described below.

Figure 4:
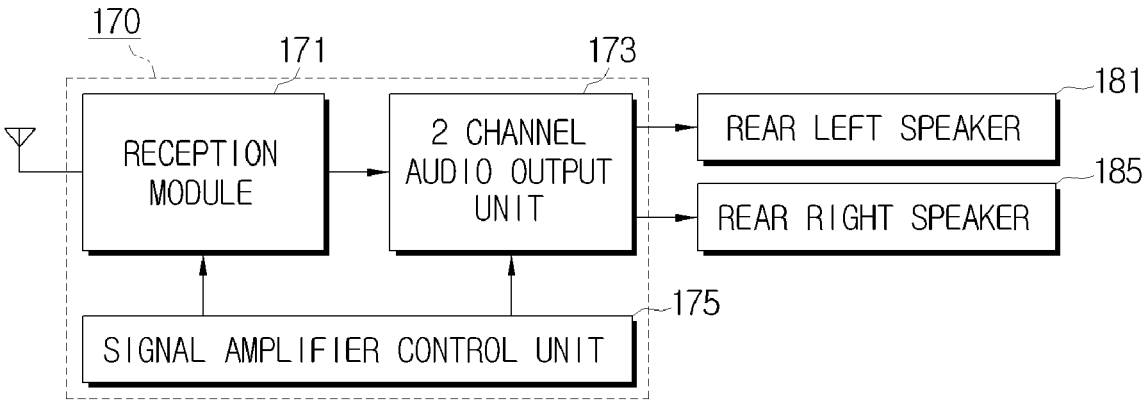
FIG. 4 is a block diagram of a signal amplifier according to an aspect of the invention.
Figure 5:
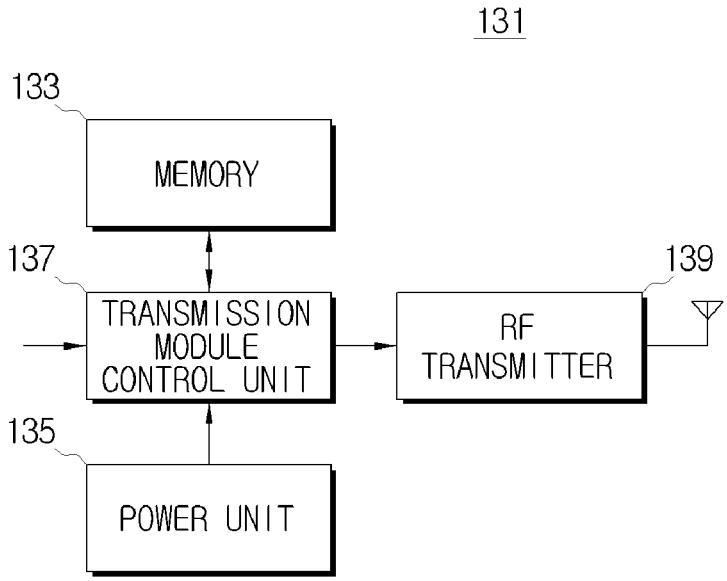
FIG. 5 is a block diagram of a transmitter according to an aspect of the invention.

The transmitter 130 includes one or more transmission modules (not shown in FIG. 1 but shown in FIG. 5). Specifically, the transmitter 130 wirelessly communicates with two or more reception modules (not shown in FIG. 1 but shown in FIGS. 3, 4, and 6) using one transmission module, or wirelessly communicates with two or more reception modules using two or more transmission modules.

The main unit 110 determines whether the transmitter 130 is mounted on the main unit 110, and if the transmitter 130 is determined to be mounted on the main unit 110, the main unit 110 wirelessly transmits an audio signal for a subwoofer channel to the subwoofer 150, and wirelessly transmits an audio signal for a rear left channel and an audio signal for a rear right channel to the signal amplifier 170.

The subwoofer 150 receives the subwoofer channel audio signal, which is for low frequency audio, and plays back the subwoofer audio signal. The signal amplifier 170 receives the rear channel audio signals, plays back the rear left channel audio signal through the rear left speaker 181, and plays back the rear right channel audio signal through the rear right speaker 185.

Figure 2:
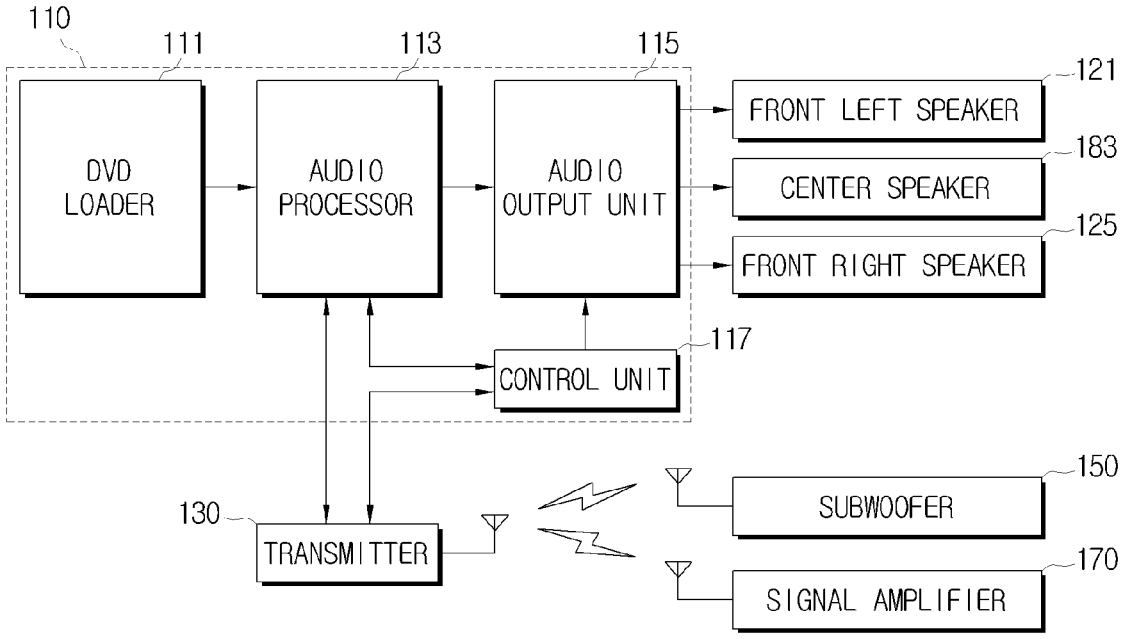
FIG. 2 is a block diagram of the main unit of the audio system of FIG. 1 according to an aspect of the invention.

FIG. 2 is a block diagram of the main unit 110 of the audio system of FIG. 1 according to an aspect of the invention. The transmitter 130, the subwoofer 150, the signal amplifier 170, the front left speaker 121, the center speaker 183 (not shown in FIG. 1), and the front right speaker 125 are all shown together for convenience of description.

The main unit 110 according to an aspect of the invention causes audio signals stored in a digital versatile disc (DVD) loaded in the main unit 110 to be output through each speaker. However, it is understood that the main unit 110 can cause audio signals obtained from other signal sources to be output through each speaker, for example, audio signals obtained from a terrestrial, satellite, or cable broadcast program, a compact disc (CD), a Blu-day disc (BD), or a high-definition digital versatile disc (HD DVD).

The main unit 110 includes a digital versatile disc (DVD) loader 111, an audio processor 113, an audio output unit 115, and a control unit 117.

The DVD loader 111 reads audio signals from a recording medium such as a DVD, in which the audio signals are compressed according to a Moving Picture Experts Group-2 (MPEG-2) format.

The DVD loader 111 transmits the read audio signals to the audio processor 113. The audio processor 113 processes the audio signals transmitted from the DVD loader 111, which may be compressed in MPEG-2 format, for example, by decompressing the audio signals, and outputs the decoded audio signals for 5.1 channels.

The audio processor 113 separates the decoded audio signals into audio signals to be transmitted by wire and audio signals to be transmitted wirelessly. The audio processor 113 transmits the audio signals to be transmitted by wire, i.e., 3 channel audio channels, to the audio output unit 115, and transmits the audio signals to be transmitted wirelessly, i.e., 2.1 channel audio signals, to the transmitter 130.

The audio output unit 115 receives the 3 channel audio signals from the audio processor 113, and converts the 3 channel audio signals into signals capable of being output through a speaker.

More specifically, the audio output unit 115 converts the 3 channel audio signals separated by the audio processor 113 into a pulse width modulation (PWM) signal using a pulse width modulation integrated circuit (PWM IC), switches the PWM signals to a wired transmission mode, and extracts audio signals for a front left channel, a center channel, and a front right channel, respectively. However, it is understood that other conversion methods may be used.

The audio output unit 115 transmits the extracted audio signals to corresponding speakers by wire. That is, the audio output unit 115 transmits the audio signal for the front left channel to the front left speaker 121, the audio signal for the center channel to the center speaker 183, and the audio signal for the front right channel to the front right speaker 125.

In this example embodiment of the invention, the front left speaker 121, the center speaker 183, and the front right speaker 125 are provided separately from the main unit 110, but this is merely an example, and some or all of the speakers 121, 183, and 125 may be mounted on the main unit 110.

The 2.1 channel audio signals transmitted from the audio processor 113 to the transmitter 130 include audio signals for the rear left speaker 181, the rear right speaker 185, and the subwoofer 150, and are wirelessly transmitted to the subwoofer 150 and the signal amplifier 170 by the transmission module (not shown) of the transmitter 130.

The control unit 117 controls an overall operation of the audio system 100. The control unit 117 controls the audio processor 113, the audio output unit 115, and the transmitter 130 to provide a user with the 5.1 channel audio signals.

The control unit 117 determines whether the transmitter 130 is mounted in the main unit 110, and decides whether to transmit the 2.1 audio signals for the subwoofer channel and the rear channels wirelessly according to a result of the determination.

The control unit 117 determines whether the transmitter 130 is mounted in the main unit 110 using a system clock generated in the transmitter 130. However, it is understood that other methods of determining whether the transmitter 130 is mounted in the main unit 110 may be used.

If the transmitter 130 is determined to be mounted on the main unit 110, the control unit 117 determines that the audio system is to operate in the wireless transmission mode, and controls the audio processor 113 to separate the 2.1 channel audio signals including the subwoofer channel audio signal and the rear channel audio signals from the 5.1 channel audio signals.

A wireless transmission mode means that some or all of the 5.1 channel audio signals are wirelessly transmitted to some or all of the speakers, and are output through the corresponding speakers. In this example embodiment of the invention, the audio signals for the subwoofer channel, the rear left channel, and the rear right channel are transmitted and output in the wireless transmission mode. However, it is understood that other combinations are possible.

The control unit 117 controls the audio processor 113 to transmit the subwoofer channel audio signal and the rear channel audio signals that are separated by the audio processor 113 to the transmitter 130.

The transmitter 130 may be implemented to transmit only the audio signal for the subwoofer channel to the subwoofer 150, and to transmit only the audio signals for the rear channels to the signal amplifier 170. Alternatively, the transmitter 130 may be implemented to transmit the audio signal for the subwoofer channel and the audio signals for the rear channels to both the subwoofer 150 and the signal amplifier 170. In this case, the subwoofer 150 and the signal amplifier 170 may be implemented to receive only a desired signal.

On the other hand, if the transmitter 130 is determined not to be mounted on the main unit 110, the control unit 117 determines that the audio system is to operate in a wired transmission mode, and controls the audio processor 113 to transmit all of the 5.1 channel audio signals to the audio output unit 115. A wired transmission mode in which the 5.1 channel audio signals are transmitted to corresponding speakers over wires, and are output through the speakers.

In the wireless transmission mode, the control unit 117 causes the audio signals for the front left channel, the center channel, and the front right channel separated by the audio output unit 115 to be transmitted by wire, that is, causes the front left channel audio signal, the center channel audio signal, and the front right channel audio signal to be transmitted by wire to the front left speaker 121, the center speaker 183, and the front right speaker 125.

Figure 3:
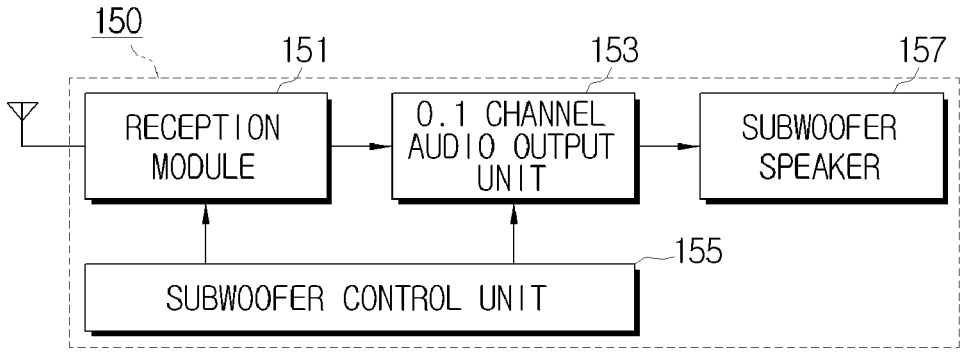
FIG. 3 is a block diagram of a subwoofer according to an aspect of the invention.

FIG. 3 is a block diagram of a subwoofer according to an aspect of the invention. The subwoofer 150 is provided to reproduce bass audio frequencies. The subwoofer 150 according to an aspect of the invention includes a reception module 151, a 0.1 channel audio output unit 153, a subwoofer control unit 155, and a subwoofer speaker 157.

The reception module 151 wirelessly receives an audio signal from the transmission module of the transmitter 130. The audio signals transmitted wirelessly from the transmission module of the transmitter 130 may include only the audio signal for the subwoofer channel, or both the audio signal for the subwoofer channel and the audio signals for the rear channels. In this example embodiment of the invention, the audio signals transmitted wirelessly from the transmission module of the transmitter 130 include both the audio signal for the subwoofer channel and the audio signals for the rear channels for convenience of description.

The reception module 151 transmits the wirelessly received audio signals to the 0.1 channel audio output unit 153.

The 0.1 channel audio output unit 153 receives the audio signals from the reception module 151, and causes the audio signal for the subwoofer channel to be output through the subwoofer speaker 157.

More specifically, the 0.1 channel audio output unit 153 receives the 2.1 channel audio signals including the subwoofer channel audio signal and the rear channel audio signals from the reception module 151, and converts the 2.1 channel audio signals into a PWM signal using an internal PWM IC. The 0.1 channel audio output unit 153 switches the converted PWM signal to a wired transmission mode, and extracts the audio signal for the subwoofer channel.

The subwoofer control unit 153 controls the 0.1 channel audio output unit 153 to amplify the extracted audio signal, and transmit the amplified audio signal to the subwoofer speaker 157. The subwoofer speaker 157 outputs the 0.1 channel subwoofer audio signal using low pass filtering.

The subwoofer control unit 155 controls an overall operation of the subwoofer 150, and controls the reception module 151 to synchronize the reception module 151 with the transmission module of the transmitter 130 using an identification (ID) transmitted by the transmission module of the transmitter 130 as described below in connection with FIGS. 7A, 7B, and 8.

FIG. 4 is a block diagram of a signal amplifier according to an aspect of the invention. The signal amplifier 170 is implemented to wirelessly receive and play back the rear left channel audio signal and the rear right channel audio signal.

The signal amplifier 170 according to an aspect of the invention includes a reception module 171, a 2 channel audio output unit 173, and a signal amplifier control unit 175.

The reception module 171 receives the audio signals that are wirelessly transmitted from the transmitter 130. The audio signals may include only the audio signals for the rear channels, or both the audio signals for the rear channels and the audio signal for the subwoofer channel.

The reception module 171 transmits the wirelessly received audio signals to the 2 channel audio output unit 173.

The 2 channel audio output unit 173 receives the audio signals from the reception module 171, and outputs the audio signals for the rear left channel and the rear right channel through the rear left speaker 181 and the rear right speaker 185, respectively.

More specifically, the 2 channel audio output unit 173 receives the 2.1 channel audio signals including the subwoofer channel audio signal and the rear channel audio signals from the reception module 171, and converts the 2.1 channel audio signals into a PWM signal using an internal PWM IC. The 2 channel audio output unit 173 switches the converted PWM signal to a wired transmission mode, and extracts the audio signals for the rear left channel and the rear right channel.

The 2 channel audio output unit 173 amplifies the extracted audio signals, and transmits the audio signals to the corresponding speakers, that is, transmits the rear left channel audio signal to the rear left speaker 181 and transmits the rear right channel audio signal to the rear right speaker 185. The rear left speaker 181 and the rear right speaker 185 then output the audio signals for the rear left channel and the rear right channel, respectively.

The signal amplifier control unit 175 controls an overall operation of the signal amplifier 170, and controls the reception module 171 to synchronize the reception module 171 with the transmission module of the transmitter 130 using an identification (ID) transmitted by the transmission module of the transmitter 130 as described below in connection with FIGS. 7A, 7B, and 8.

FIG. 5 is a block diagram of a transmitter according to an aspect of the invention. The transmitter 130 may be implemented as a card, and is detachably mounted on the main unit 110. The transmitter 130 transmits audio signals to be wirelessly transmitted among audio signals transmitted from the main unit 110.

The transmitter 130, according to an aspect of the invention, includes one transmission module 131, and thus the transmitter 130 is identical to the transmission module 131. However, this is merely an example embodiment of the invention for convenience of description, and it is understood that the transmitter 130 may include two or more transmission modules.

The transmitter 130 includes a memory 133, a power unit 135, a transmission module control unit 137, and a radio frequency (RF) transmitter 139.

The memory 133 stores programs required to cause the transmission module control unit 137 to operate the transmission module 131.

The power unit 135 receives power from the main unit 110, and converts alternating current (AC) voltage to direct current (DC) voltage. The DC voltage is applied to the transmission module control unit 137, and drives components thereof.

The transmission module control unit 137 controls an overall operation of the transmission module 131. The transmission module control unit 137 receives a control signal to be wirelessly transmitted from the control unit 117 of the main unit 110, and selects a signal modulation method for the wireless transmission according to the control signal. The transmission module control unit 137 controls the RF transmitter 139 using the received control signal.

The transmitter 130 is detachably mounted on the main unit 110, and determines whether the transmitter 130 is mounted on the main unit 110. The transmission module control unit 137 transmits a system clock to the control unit 117 of the main unit 110 to notify the main unit 110 that the transmitter 130 is mounted on the main unit 110.

The transmission module control unit 137 receives the audio signals for the 2.1 channels from the audio processor 113 of the main unit 110, and transmits the received audio signals to the RF transmitter 139.

The RF transmitter 139 selects a modulation method according to the control signal transmitted from the transmission module control unit 137, and wirelessly transmits the audio signals for the 2.1 channels.

Figure 6:
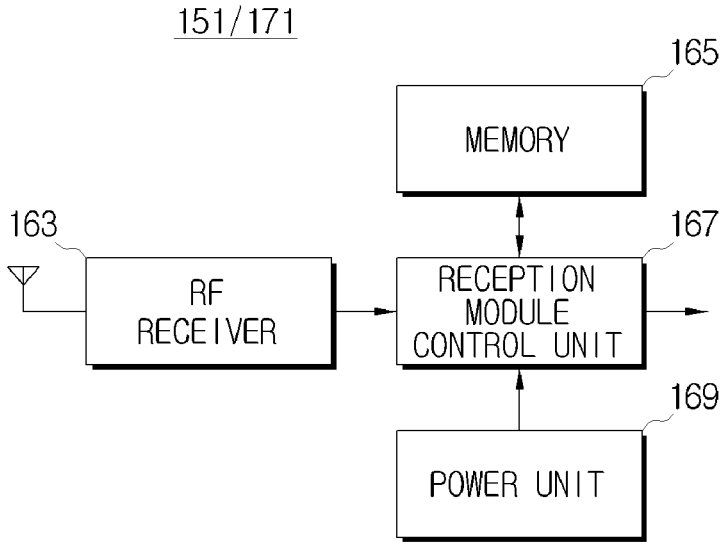
FIG. 6 is a block diagram of a reception module according to an aspect of the invention.

FIG. 6 is a block diagram of a reception module according to an aspect of the invention. The reception module 151 or 171 is housed in the subwoofer 150 or the signal amplifier 170 to receive audio signals wirelessly transmitted from the main unit 110 and to play back the audio signals.

The reception module 151 or 171 includes a radio frequency (RF) receiver 163, a memory 165, a reception module control unit 167, and a power unit 169.

The RF receiver 163 selects a signal modulation method according to the control signal transmitted from the reception module control unit 167, which will be explained below, and wirelessly receives the 0.1 channel audio signal or the 2 audio signal transmitted from the RF transmitter 139.

That is, in the reception module 151 installed in the subwoofer 150, the RF receiver 163 receives the audio signal for 0.1 channel. However, the reception module 151 of the subwoofer 150 is provided as an example embodiment of the invention for convenience of description. Accordingly, an RF receiver of the reception module 171 installed in the signal amplifier 170 receives the audio signals for the 2 channels.

The memory 163 stores programs required to cause the reception module control unit 167 to operate the reception module.

The power unit 169 generates power to drive components of the reception module 151, and applies the generated power to the reception module control unit 167.

The reception module control unit 167 controls an overall operation of the reception module. The reception module control unit 167 generates a control signal, and selects a modulation method for wireless communication with a transmission module. The reception module control unit 167 controls the wireless reception of the RF receiver 163 using the control signal.

Figure 7A:
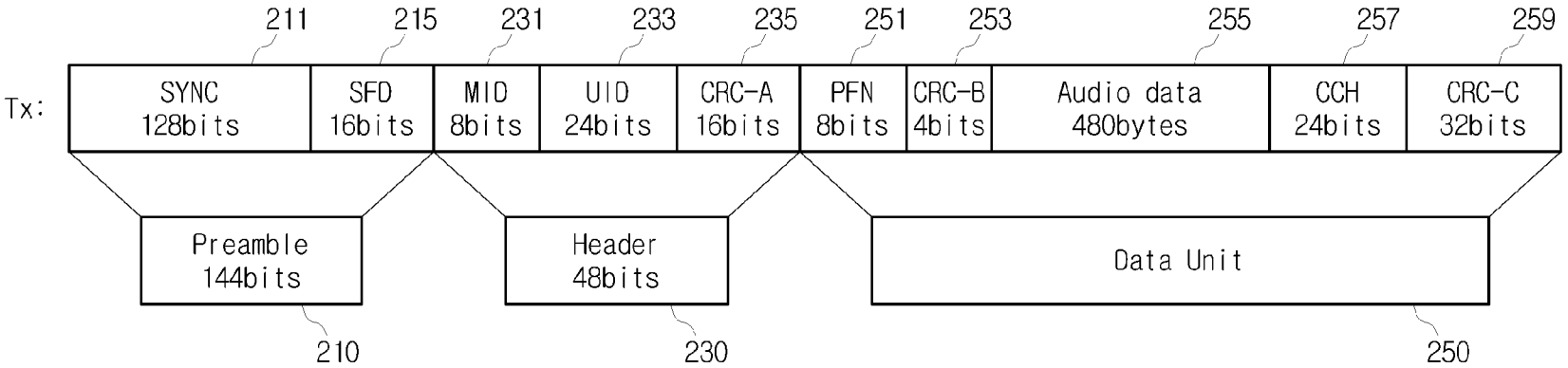
FIGS. 7A and 7B are diagrams of packet data structures of wireless transmissions in an audio system according to an aspect of the invention.
Figure 7B:
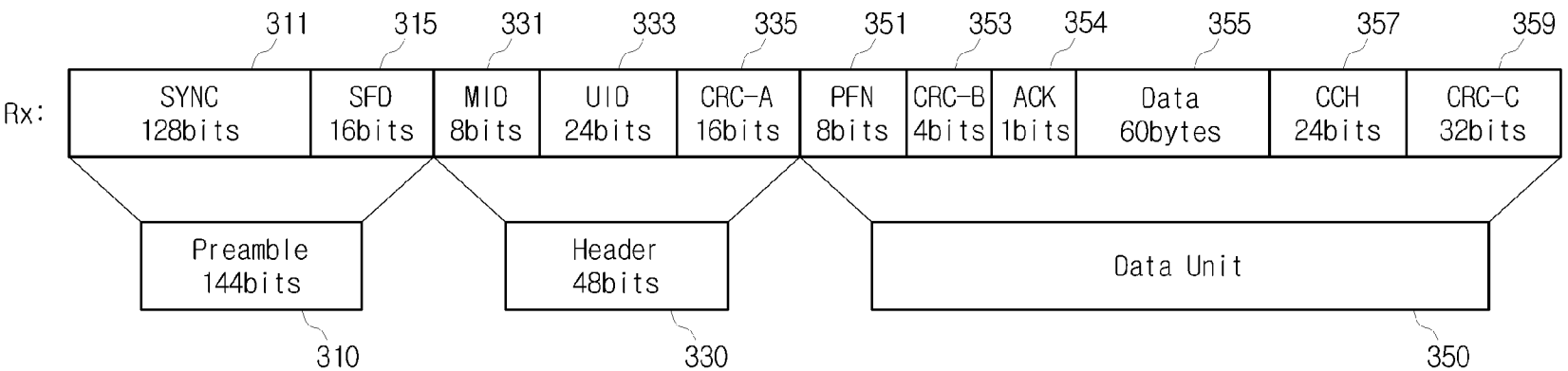

FIGS. 7A and 7B are diagrams of packet data structures of wireless transmissions in an audio system according to an aspect of the invention.

FIG. 7A shows a packet data structure used when the transmitter 130 wirelessly transmits audio signals to the reception module 151 of the subwoofer 150 and the reception module 171 of the signal amplifier 170.

The packet transmitted from the transmitter 130 includes a preamble 210, a header 230, and a data unit 250.

The preamble 210 is placed at the beginning of the packet, and includes pieces of information regarding synchronization and header. The preamble 210 includes a 128-bit synchronization (SYNC) 211 and a 16-bit start frame delimiter (SFD) 215.

The SYNC 211 includes information for synchronization with the reception modules 151 and 171. The SFD 215 includes information indicating that packet streams of the header 230 are transmitted thereafter.

Therefore, the transmitter 130 transmits data while being synchronized with the reception modules 151 and 171, and the reception modules 151 and 171 classify the packet streams transmitted from the transmitter 130 into the preamble 210 and the header 230.

The header 230 is placed between the preamble 210 and the data unit 250, and includes information for identifying an ID prior to transmitting data. The header 230 includes a 8-bit manufacturer identification (MID) 231, a 24-bit user identification (UID) 233, and a 16-bit cyclic redundancy check-A (CRC-A) 235.

The MID 231 includes information regarding the ID of a manufacturer, and the UID 233 includes information regarding a user, and are used to synchronize the reception modules 151 and 171 of the subwoofer 150 and the signal amplifier 170 with the transmission module of the transmitter 130.

The CRC detects common errors caused by noise in transmission channels using a cyclic binary code. The transmitter 130 transmits information specified using a binary polynomial expression to the CRC, and detects whether the reception modules 151 and 171 acquire the same information using the same expression in order to determine if there is a transmission error.

The CRC-A 235 is placed after the MID 231 and the UID 233, and includes information to detect whether errors occur when the MID 231 and the UID 233 are transmitted.

The data unit 250 is placed at the end of the packet, and includes information to transmit audio data.

The data unit 250 includes a 8-bit packet frame number (PFN) 251, a 4-bit cyclic redundancy check-B (CRC-B) 253, 480-byte audio data 255, a 24-bit control channel (CCH) 257, and a 32-bit cyclic redundancy check-C (CRC-C) 259.

The PFN 251 includes information to count the number of packet transmissions from the transmitter 130 to the reception modules 151 and 171. The transmitter 130 compares the information on the PFN 251 of the transmission module with the information on the PFN 251 of the reception modules 151 and 171, and determines whether the correct data are transmitted and received.

The CRC-B 253 is placed following the PFN 251, and includes information to detect whether errors occur when the PFN 251 is transmitted.

The audio data 255 include information regarding the 2.1 channel audio signals consisting of the subwoofer channel audio signal and the rear channel audio signals.

The audio data 255 include data 1 (D1) and data 2 (D2) (not shown). D1 includes data of the rear channel audio signals, and D2 includes data of the subwoofer channel audio signal.

D1 having the data of the rear channel audio signals alternately includes information regarding the rear left channel audio signal and information regarding the rear right channel audio signal. D2 having the data of the subwoofer channel audio signal alternately includes information regarding the subwoofer channel audio signal and a blank. The blank represents null data having no information.

The audio data 255 are transmitted to the reception module 151 of the subwoofer 150 and the reception module 171 of the signal amplifier 170. Each of the reception modules 151 and 171 converts the audio data 255 into a PWM signal, switches the converted PWM signal to a wired transmission mode, and extracts the audio signal for a desired channel among the subwoofer channel, the rear left channel, and the rear right channel.

The CCH 257 includes information to control communication between the transmitter 130 and the reception modules 151 and 171, and information to control volume.

The CRC-C 259 is placed after the CCH 257, and includes information to detect whether errors occur when the audio data 255 and the CCH 257 are transmitted.

FIG. 7B shows a packet data structure used when the reception module 151 of the subwoofer 150 and the reception module 171 of the signal amplifier 170 transmit signals to the transmitter 130.

The packet transmitted from the reception modules 151 and 171 to the transmitter 130 includes a preamble 310, a header 330, and a data unit 350.

The preamble 310, header 330, and data unit 350 include a SYNC 311, SFD 315, MID 331, UID 333, CRC-A 335, PFN 351, CRC-B 353, CCH 357, and CRC-C 359 that are substantially identical to SYNC 211, SFD 215, MID 231, UID 233, CRC-A 235, PFN 251, CRC-B 253, CCH 257, and CRC-C 259 of the preamble 210, header 230, and data unit 250 in FIG. 7A. Accordingly, only different packets, that is, ACK 354 and data 355, will be explained below.

The acknowledgement (ACK) 354 includes information for responding to the secure reception of a packet including audio data from the transmitter 130.

The data unit 355 may include voice information, or may be empty when the voice information is not required.

While FIGS. 7A and 7B show specific numbers of bits being allocated to each block of the packet, this is merely an example for convenience of description, and it is understood that the number of bits allocated to the blocks may vary. It is also understood that the blocks in the packet may be arranged in a different order, and that the packet may have a different structure that may include additional packets or may omit certain packets.

Figure 8:
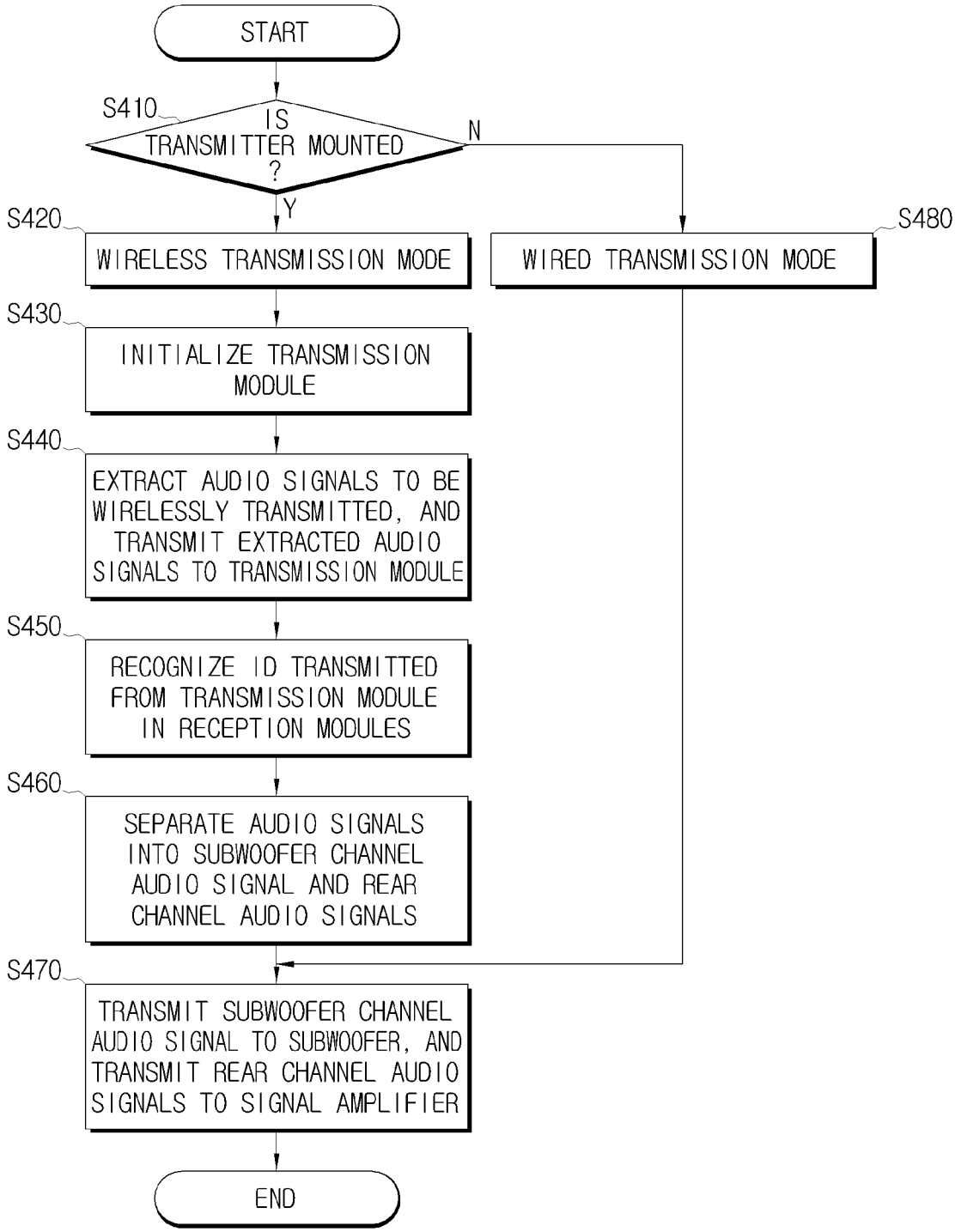
FIG. 8 is a flowchart of a method of wirelessly transmitting an audio signal in an audio system according to an aspect of the invention.

FIG. 8 is a of a method of wirelessly transmitting an audio signal in an audio system according to an aspect of the invention.

The main unit 110 determines whether the transmitter 130 is mounted on the main unit 110 using a system clock generated in the transmitter 130 (S410).

If the transmitter 130 is determined to be mounted on the main unit 110 (S410-Y), the main unit 110 determines that the audio apparatus is to operate in a wireless transmission mode, and prepares for a wireless transmission and a wired transmission (S420). In the wireless transmission mode according to an aspect of the invention, the audio apparatus simultaneously performs the wireless transmission and the wired transmission.

More specifically, if the transmitter 130 is mounted on the main unit 110 (S410-Y), the main unit 110 prepares for a wireless transmission of the subwoofer channel, the rear left channel, and the rear right channel, and prepares for a wired transmission of the front left channel, the center channel, and the front right channel.

The wireless transmission and the wired transmission are simultaneously performed in the wireless transmission mode for convenience of description. However, it is understood that audio signals for all of the channels may be transmitted wirelessly in the wireless transmission mode.

If the transmitter 130 is determined not to be mounted on the main unit 110 (S410-N), the main unit 110 determines that the audio apparatus is to operate in a wired transmission mode, and prepares for a wired transmission (S480).

The operation of the audio system 100 will now be explained when the audio system 100 is to operate in the wireless transmission mode (S420).

If the audio system 100 is to operate in the wireless transmission mode, the main unit 110 initializes the transmission module 131 of the transmitter 130 (S430).

The main unit 110 extracts the subwoofer channel audio signal, the rear left channel audio signal, and the rear right channel audio signal, that is, the audio signals that are to be wirelessly transmitted, from the 5.1 channel audio signals, and transmits the extracted audio signals to the transmission module 131 of the transmitter 130 (S440).

The reception modules 151 and 171 of the subwoofer 150 and the signal amplifier 170 recognize an ID transmitted from the transmission module 131 of the transmitter 130 that is required for wireless communication between the transmission module 131 of the transmitter 130 and the reception modules 151 and 171 (S450). The process of recognizing the ID is required to synchronize the reception modules 151 and 171 with the transmission module 131 of the transmitter 130 to enable the wireless communication.

After the reception modules 151 and 171 have achieved synchronization with the transmission module 131 of the transmitter 130 by recognizing the ID, the transmission module 131 of the transmitter 130 separates the extracted 2.1 channel audio signals into the subwoofer channel audio signal and the rear channel audio signals (S460).

Next, the transmission module 131 of the transmitter 130 transmits the subwoofer channel audio signal to the reception module 151 of the subwoofer 150, and transmits the rear channel audio signals to the reception module 171 of the signal amplifier 170 (S470).

In example embodiment of the invention described above, the 2.1 channel audio signals are separated into the subwoofer channel audio signal and the rear channel audio signals, the subwoofer channel audio signal is transmitted to the reception module 151 of the subwoofer 150, and the rear channel audio signals are transmitted to the reception module 171 of the signal amplifier 170, respectively. However, it is understood that the 2.1 channel audio signals may be transmitted to both the reception module 151 of the subwoofer 150 and the reception module 171 of the signal amplifier 170. In this situation, the transmission module 131 of the transmitter 130 concurrently transmits the audio signals for the rear channels, that is 2 channels, and the audio signal for the subwoofer channel, that is 0.1 channel, to the reception modules 151 and 171 using a time-sharing method.

The transmission module and the reception modules may check the transmission condition of frequency bands available for wirelessly transmitting the audio signals, and wirelessly transmit the audio signals in an optimal frequency band. The transmission module and the reception modules may preset a specific frequency band to use to wirelessly transmit the audio signals, and first attempt to wirelessly transmit the audio signals in the preset frequency band. If it is determined that the transmission condition of the preset frequency band is poor, the transmission module and the reception modules may search other frequency bands sequentially, randomly, or otherwise to find an optimal frequency band, and wirelessly transmit the audio signals in the optimal frequency band.

A plurality of memories 155 may be provided in the reception module 151. When errors occur in the process of receiving audio signals, the audio signals are re-transmitted to correct the errors. If a plurality of memories 155 are provided, data of the bits having errors are temporarily stored in the memory, so that the audio signals can be transmitted rapidly and accurately.

Although the audio system 100 is described above as wirelessly transmitting some of the 5.1 channel audio signals, this is merely exemplary, and it is understood that all of the audio signals of the 5.1 channel audio signals may be wirelessly transmitted. Alternatively, an audio system may be implemented to wirelessly transmit some or all of the audio signals of any other multichannel audio signals, such as 5.2, 6.1, 6.2, 7.1, 7.2, 10.2, or 22.2 channel audio signals, or any other multichannel audio signals.

As described above, according to an aspect of the invention, the audio signals for the subwoofer channel and the rear channels are transmitted wirelessly, but this is merely exemplary, and it is understood that the channels of the audio signals that are wirelessly transmitted may be many different channels and/or combinations of channels, such as front channels and rear channels, or a subwoofer channel and front channels, or a subwoofer channel and a rear left channel, or any other combination of channels.

As described above, according to an aspect of the invention, the audio signals for the rear channels are received using a separate signal amplifier, but this is merely exemplary, and it is understood that the rear left speaker and/or the rear right speaker may house reception module and the other components of the signal amplifier so that the audio signals for the rear channels may be received without using the separate signal amplifier.

As described above, according to an aspect of the invention, one transmission module is provided in the transmitter to transmit audio signals to one reception module provided for the subwoofer channel and one reception module provided for the rear channels. However, this is merely exemplary, and it is understood that one transmission module may be provided for the subwoofer channel and one transmission module may be provided for the rear channels. Alternatively, three transmission modules may be provided, one of each for each of the subwoofer channel, the rear right channel, and the rear left channel, and three reception modules may be provided, one for each of the subwoofer channel, the rear right channel, and the rear left channel.

As described above, according to an aspect of the present invention, the transmission module is detachably mounted on the main unit, and the reception modules are housed in the subwoofer and the signal amplifier, but this is merely exemplary, and it is understood that the transmission module may be housed in the main unit, and the reception modules may be detachably mounted on the subwoofer and the signal amplifier.

As described above, according to an aspect of the invention, the audio signal corresponding to each speaker is output from the corresponding speaker. For example, the audio signal for the center channel is output from the center speaker, the audio signal for the left front channel is output from the left front speaker, and the audio signal for the front right channel is output from the front right speaker. However, this is merely exemplary, and it is understood that the center speaker may output the audio signals for the center channel, the front left channel, and the front right channel, or the front left speaker and the front right speaker may output the audio signal for the center channel.

As described above, according to an aspect of the invention, audio signals are wirelessly transmitted without connecting a wire between the main unit and some or all of the speakers. Therefore, a user does not need to undergo the inconvenience of connecting the wires, and thus can easily install the speakers.

While there have been shown and described what are considered to be example embodiments of the invention, it will be understood by those skilled in the art and as technology develops that changes and modifications may be made in these example embodiment, and equivalents may be substituted for elements thereof, without departing from the true scope of the invention. Many modifications, permutations, additions and sub-combinations may be made to adapt the teachings of the invention to particular situations without departing from the scope thereof. Accordingly, it is intended, therefore, that the invention not be limited to the various example embodiments disclosed herein, but include all embodiments falling within the scope of the claims and their equivalents.

What is claimed is:

1. An audio apparatus comprising:

a control unit to extract each of audio signals for respective channels from a multichannel audio signal and to determine that the audio apparatus is in a wired transmission mode, if a transmitter is determined not to be mounted, otherwise, to determine that the audio apparatus is in a wireless tansmission mode; and a transmitter to wirelessly transmit at least one transmission signal including at least two extracted audio signals corresponding to different channels to a first receiver, when the audio apparatus is in the wireless transmission mode, the transmitter being detachably mounted on the audio apparatus.

2. The audio apparatus of claim 1, wherein:

the at least one transmission signal wirelessly transmitted to the first receiver includes rear channel audio signals for rear channels.

3. The audio apparatus of claim 1, wherein the transmitter is detachably mounted on the control unit.

4. The audio apparatus of claim 3, wherein:

the control unit detects whether the transmitter is mounted on the control unit; and if the transmitter is mounted on the control unit, the control unit controls the transmitter to wirelessly transmit the at least one transmission signal including at least two extracted audio signals to the first receiver.

5. The audio apparatus of claim 1, wherein the first receiver is not connected by wire to the control unit, and is not connected by wire to a second receiver.

6. The audio apparatus of claim 1, wherein:

the at least one transmission signal including at least two extracted audio signals wirelessly transmitted to the first receiver includes rear channel audio signals for rear channels; and the first receiver comprises:

a first reception module to receive the rear channel audio signals for the rear channels; and a first signal amplifier to amplify the received rear channel audio signals for the rear channels.

7. The audio apparatus of claim 6, wherein:

the rear channel audio signals for the rear channels comprise:

a rear left audio signal for a rear left channel; and a rear right audio signal for a rear right channel; and the first signal amplifier outputs an amplified rear left audio signal for the rear left channel to a rear left speaker, and outputs an amplified rear right audio signal for the rear right channel to a rear right speaker.

8. The audio apparatus of claim 1, further including the transmitter wirelessly transmitting at least one other audio signal of the extracted audio signals to a second receiver, the at least one other audio signal wirelessly transmitted to the second receiver is a subwoofer channel audio signal for a subwoofer channel; and the second receiver comprises: a second reception module to receive the subwoofer channel audio signal for the subwoofer channel;

a second signal amplifier to amplify the received subwoofer channel audio signal for the subwoofer channel; and a speaker to reproduce the amplified subwoofer channel audio signal for the subwoofer channel.

9. A method of transmitting audio signals, comprising:

extracting each of audio signals for respective channels from a multichannel audio signal;

determining that an audio apparatus is in a wired transmission mode, if a transmitter is determined not to be mounted thereto, otherwise, determining that the audio apparatus is in a wireless transmission mode; and wirelessly transmitting at least one transmission signal including at least two extracted audio signals corresponding to different channels to a receiver when the audio apparatus is in the wireless transmission mode.

10. The method of claim 9, wherein:

the at least one transmission signal including at least two extracted audio signals wirelessly transmitted to the first receiver includes rear channel audio signals for rear channels, and further including transmitting at least one other audio signal wirelessly to a second receiver wherein the at least one other audio signal is the subwoofer channel audio signal for the subwoofer channel.

11. The method of claim 10, further comprising detecting whether a transmitter is available;

wherein: the wirelessly transmitting of the at least one transmission signal including at least two extracted audio signals to the first receiver comprises controlling the transmitter to wirelessly transmit the one transmission signal including at least two extracted audio signals to the first receiver if the transmitter is available; and the wirelessly transmitting of the at least one other audio signal to the second receiver comprises controlling the transmitter to wirelessly transmit the at least one other audio signal to the second receiver if the transmitter is available.

12. The method of claim 10, wherein:

the at least one transmission signal including at least two extracted audio signals and the at least one other audio signal are wirelessly transmitted from a control unit to the first receiver and the second receiver, respectively; and the first receiver and the second receiver are not connected by wire to the control unit, and are not connected by wire to each other.

13. An audio system comprising:

a control unit to extract each of audio signals for respective channels from a multichannel audio signal and to determine that the audio system is in a wired transmission mode, if a transmitter is determined not to be mounted, otherwise, to determine that the audio system is in a wireless transmission mode; and a transmitter to wirelessly transmit at least one transmission signal including at least two extracted audio signals corresponding to different channels to a receiver, when the audio system is in the wireless transmission mode, the transmitter being detachably mounted on the audio system.

14. The audio system of claim 13, wherein:

the at least one transmission signal including at least two extracted audio signals wirelessly received by the first receiver includes rear channel audio signals for rear channels, and transmitting at least one other audio signal wirelessly to a second receiver, and the at least one other audio signal is the subwoofer channel audio signal for the subwoofer channel.

15. The audio system of claim 13, wherein:

the extracted audio signals comprise:

a front left channel audio signal for a front left channel; and a front right channel audio signal for a front right channel; and the audio system further comprises:

a third receiver connected to the control unit by wire to receive the front left channel audio signal for the front left channel by wire from the control unit; and a fourth receiver connected to the control unit by wire to receive the front right channel audio signal for the front right channel by wire from the control unit.

16. An audio system comprising:

a control unit to extract each of a plurality of audio signals for respective channels from a multichannel audio signal and to determine that the audio system is in a wired transmission mode, if a transmitter is determined not to be mounted, otherwise, to determine that the audio system is in a wireless transmissin mode, the plurality of audio signals comprising:

an audio signal for a front left channel;

an audio signal for a center channel;

an audio signal for a front right channel;

an audio signal for a rear left channel;

an audio signal for a rear right channel; and an audio signal for a subwoofer channel;

a plurality of speakers comprising:

a front left speaker to reproduce the audio signal for the front left channel;

a center speaker to reproduce the audio signal for the center channel;

a front right speaker to reproduce the audio signal for the front right channel;

a rear left speaker to reproduce the audio signal for the rear left channel;

a rear right speaker to reproduce the audio signal for the rear right channel;

a first receiver connected by wire to at least one of the plurality of speakers; and a transmitter to wirelessly transmit at least one transmission signal including at least two extracted audio signals corresponding to different channels to the first receiver, of the extracted audio signals corresponding to the ones of the plurality of speakers connected by wire to the first receiver, when the audio system is in the wireless transmission mode, the transmitter being detachably mounnted on the audio system.

17. The audio system of claim 16, further including a second receiver connected by wire to at least one of the plurality of speakers other than the at least one of the plurality of speakers connected by wire to the first receiver, wherein the transmitter wirelessly transmits to the second receiver ones of the plurality of extracted audio signals corresponding to the ones of the plurality of speakers connected by wire to the second receiver;

wherein any of the plurality of speakers not connected by wire to the first receiver and the second receiver are connected by wire to the control unit, the second receiver is connected by wire to the subwoofer to reproduce the audio signal for the subwoofer channel;

the first receiver is connected by wire to the rear left speaker and the rear right speaker;

the front left speaker, the center speaker, and the front right speaker are connected by wire to the control unit; and the transmitter wirelessly transmits the audio signal for the subwoofer channel to at least the second receiver, and wirelessly transmits the audio signal for the rear left channel and the audio signal for the rear right channel to at least the first receiver.

18. The audio system of claim 17, wherein the transmitter wirelessly transmits the audio signal for the subwoofer channel to only the second receiver, and wirelessly transmits the audio signal for the rear left channel and the audio signal for the rear right channel to only the first receiver.

19. The audio system of claim 17, wherein:

the transmitter wirelessly transmits to both the first receiver and the second receiver a 2.1 channel audio signal comprising the audio signal for the subwoofer channel, the audio signal for the rear left channel, and the audio signal for the rear right channel;

the second receiver extracts the audio signal for the subwoofer channel from the 2.1 channel audio signal; and the first receiver extracts the audio signal for the rear left channel and the audio signal for the rear right channel from the 2.1 channel audio signal.

20. The audio system of claim 16, wherein:

the transmitter is detachably mounted on the control unit; the control unit comprises respective wired connections for all of the plurality of speakers;

the control unit detects whether the transmitter is mounted on the control unit;

the control unit controls the transmitter to wirelessly transmit to the first receiver and the second receiver the ones of the plurality of audio signals corresponding to the ones of the plurality of speakers connected by wire to the first receiver and the second receiver if the control unit detects that the transmitter is mounted on the control unit; and the control unit outputs the plurality of audio signals to respective ones of the plurality of wired connections if the control unit detects that the transmitter is not mounted on the control unit.

21. An audio system comprising:

an audio transmission apparatus which extracts each of the audio signals for respective channels from a multichannel audio signal, determines that the audio transmission apparatus is in a wired transmission mode, if a transmitter is determined not to be mounted thereto, otherwise, to determine that the audio transmission apparatus is in a wireless transmission mode and wirelessly transmits at least one transmission signal including at least two audio signals corresponding to different channels to a receiver, when the audio transmission apparatus is in the wireless transmission mode; and an audio output apparatus which receives the transmission signal from the audio transmission apparatus wirelessly and extracts the at least two audio signals corresponding to different channels from the transmission signal.

* * * * *